US005575616A

United States Patent [19]

Hagle et al.

[11] Patent Number: 5,575,616

[45] Date of Patent: Nov. 19, 1996

[54] TURBINE COOLING FLOW MODULATION APPARATUS

[75] Inventors: Michael P. Hagle, Erie, Pa.; John P. McKay, Newport, Ky.

[73] Assignee: General Electric Company, Cincinnati, Ohio

[21] Appl. No.: 320,637

[22] Filed: Oct. 11, 1994

[51] Int. Cl.[6] ..... F01D 5/00

[52] U.S. Cl. ..... 415/115; 415/175; 415/157; 416/95

[58] Field of Search ..... 415/115, 47, 157, 415/167, 175; 416/95; 60/39.75, 39.83

[56] References Cited

U.S. PATENT DOCUMENTS

| | | | |
|---|---|---|---|
| 2,811,833 | 11/1957 | Broffitt | 415/115 |
| 2,951,340 | 9/1960 | Howald | 60/39.75 |
| 3,575,528 | 4/1971 | Beam, Jr. et al. | 416/95 |
| 3,712,756 | 1/1973 | Kalikow et al. | 415/175 |
| 4,217,755 | 8/1980 | Williams | 416/95 |
| 4,296,599 | 10/1981 | Adamson | 416/95 |
| 4,416,111 | 11/1983 | Lenahan et al. . | |
| 4,785,624 | 11/1988 | Smith et al. . | |
| 4,805,398 | 2/1989 | Jourdain et al. | 415/47 |
| 4,807,433 | 2/1989 | Maclin et al. . | |
| 4,882,902 | 11/1989 | Reigel et al. . | |
| 5,178,003 | 1/1993 | Wesorick . | |
| 5,245,821 | 9/1993 | Thomas, Jr. et al. . | |

FOREIGN PATENT DOCUMENTS

| | | | |
|---|---|---|---|
| 2103289 | 2/1983 | United Kingdom | 60/39.83 |

*Primary Examiner*—James Larson
*Attorney, Agent, or Firm*—Andrew C. Hess; Patrick R. Scanlon

[57] ABSTRACT

An apparatus for modulating a flow of cooling air from a compressor to a turbine in a gas turbine engine is disclosed. The apparatus includes a support member which forms a channel for receiving the cooling flow and has a throat at a downstream end with a radial orientation. A radial flow inducer is connected to the support member adjacent to the channel downstream end for accelerating the cooling flow through the throat of the support member. Apparatus for modulating the quantity of the cooling air flowing through the throat and into the turbine is provided in the form of an axially translating endwall, wherein variation of the throat area is accomplished through modulation of the endwall with respect to the support member. The support member may also house either a stationary, unmodulated axial flow inducer or a second modulated radial flow inducer in addition to the modulated radial flow inducer.

19 Claims, 7 Drawing Sheets

TURBINE COOLING FLOW MODULATION APPARATUS

BACKGROUND OF THE INVENTION

1. Field of the Invention

The present invention relates to the cooling of turbine components in a gas turbine engine and, more particularly, to a variable radial flow inducer for modulating the cooling air flow to such turbine components.

2. Description of Related Art

Gas turbine engines typically include cooling systems which provide cooling air to turbine rotor components, such as turbine blades, in order to limit the temperatures experienced by such components. Prior art cooling systems usually acquire the air used to cool turbine components from the engine's compressor, after which it is diverted and subsequently directed to the turbine section of the engine through an axial passageway. A device commonly known as an inducer is generally located at the exit end of such an axial passageway in order to accelerate the airflow before it impinges on the turbine components to be cooled. Such inducers, frequently in the form of a circumferentially disposed array of vanes, are used to control the tangential speed of the airflow so that it is substantially equal to that of the turbine rotor. An exemplary inducer utilized for such purpose is disclosed in U.S. Pat. No. 4,882,902 to James R. Reigel et al., entitled "Turbine Cooling Air Transferring Apparatus." Another inducer performing a similar function to the vane-type inducer is disclosed in U.S. Pat. No. 5,245,821 to Theodore T Thomas Jr et al entitled "Stator to Rotor Flow Inducer," where a plurality of cylindrical airflow passages are disposed circumferentially about the engine centerline.

An important factor in the design of cooling systems is its relationship to the efficiency of the gas turbine engine. In current prior art systems, the amount of cooling flow is generally fixed at a level required to achieve requisite cooling at the maximum turbine inlet temperature point for the engine. Since an engine is usually run at conditions which are less than maximum turbine inlet temperature, this causes the engine to normally operate with excess cooling flow and decreased efficiency. This excess cooling also has the effect of increasing overall engine specific fuel consumption. Accordingly, an apparatus capable of modulating the flow of cooling air through an inducer to the turbine components in response to changes in the turbine inlet gas temperature would increase the efficiency of the gas turbine engine and be most desirable.

As seen in U.S. Pat. No. 4,807,433, some turbine cooling systems modulate the amount of cooling air provided to the turbine in accordance with the engine cycle. These systems, however, are inefficient because they modulate the airflow at the point where diverted from the compressor, resulting in flow losses prior to the air reaching the turbine. While it is also known for cooling systems in the prior art to employ an axial flow inducer at the exit of the cooling flow path, modulation of the cooling airflow at this axial location has been avoided due to design complexity. Consequently, there exists an unfulfilled need for an apparatus which modulates the flow of cooling air to the turbine at the exit of the cooling flow system

SUMMARY OF THE INVENTION

In accordance with the present invention, an apparatus for modulating a flow of cooling air from a compressor to a turbine in a gas turbine engine is disclosed. The apparatus includes a support member which forms a channel for receiving the cooling flow and has a throat at a downstream end with a radial orientation. A radial flow inducer is connected to the support member adjacent to the channel downstream end for accelerating the cooling flow through the throat of the support member. Means for modulating the quantity of the cooling air flowing through the throat and into the turbine is provided in the form of an axially translating endwall, wherein variation of the throat area of the radial flow inducer is accomplished through modulation of the endwall with respect to the support member. Further, the support member may additionally house either a stationary, unmodulated axial flow inducer or a second modulated radial flow inducer.

BRIEF DESCRIPTION OF THE DRAWING

While the specification concludes with claims particularly pointing out and distinctly claiming the present invention, it is believed that the same will be better understood from the following description when taken in conjunction with the accompanying drawing in which:

DETAILED DESCRIPTION OF THE INVENTION

Figure 1:
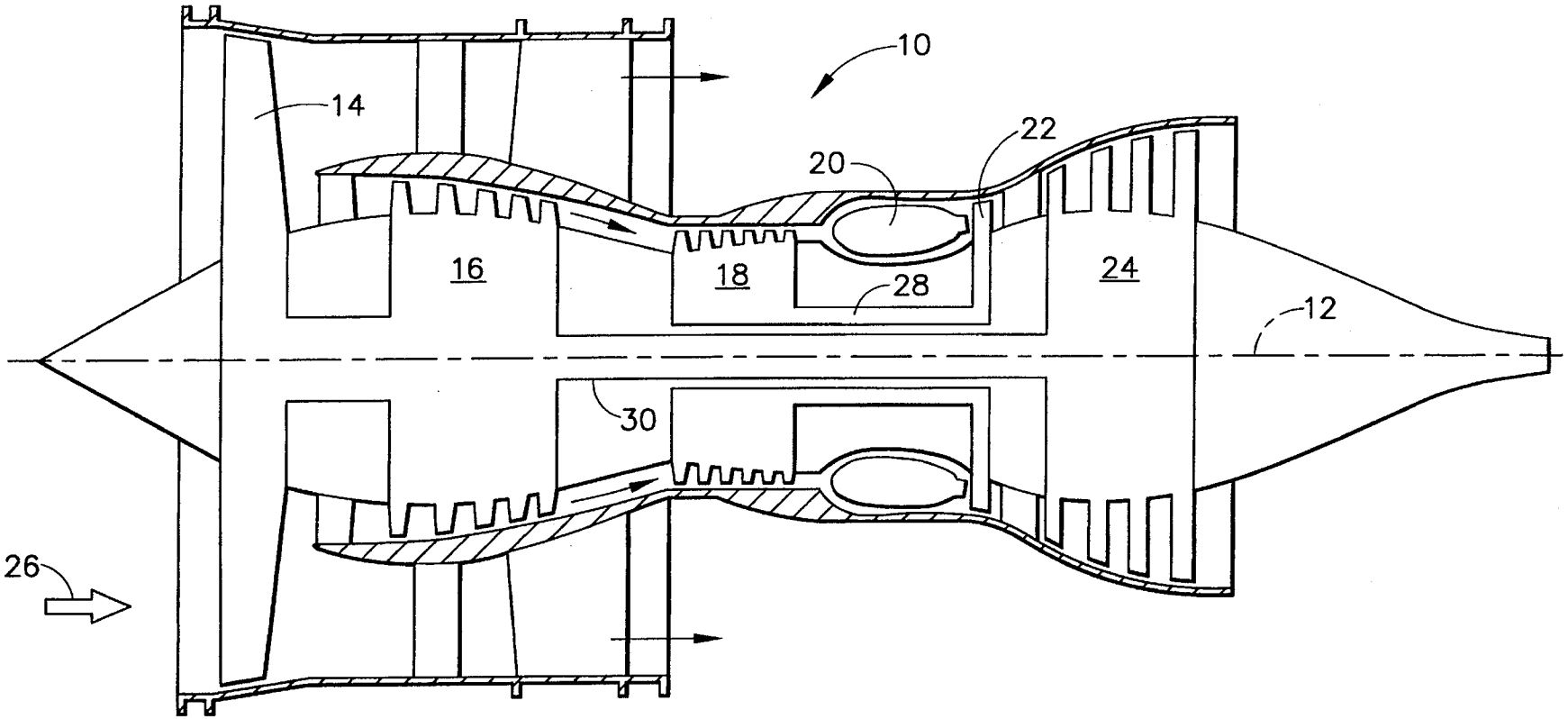
FIG. 1 is a cross-sectional view of a typical gas turbine engine.

Referring now to the drawing in detail, wherein identical numerals indicate the same elements through the figures, FIG. 1 depicts an axial flow gas turbine engine shown generally at 10. Engine 10 includes, in a serial flow relationship along an engine centerline 12, a fan 14, a low pressure compressor 16, a high pressure compressor 18, a combustor 20, a high pressure turbine 22, and a low pressure turbine 24.

In conventional operation, inlet air 26 is pressurized by fan 14, low pressure compressor 16, and high pressure compressor 18. A major portion of inlet air 26 is then channeled into combustor 20, where it is mixed with fuel for generating relatively high pressure combustion gases. These combustion gases flow through high pressure turbine 22, where power is extracted for and transmitted to high pressure compressor 18 through an interconnecting high pressure shaft 28. After passing through high pressure turbine 22, the combustion gases then pass through low pressure turbine 24, where power is extracted for and transmitted to low pressure compressor 16 and fan 14 through an interconnecting low pressure shaft 30. After passing through low pressure turbine 24, the combustion gases are discharged from engine 10.

Figure 2:
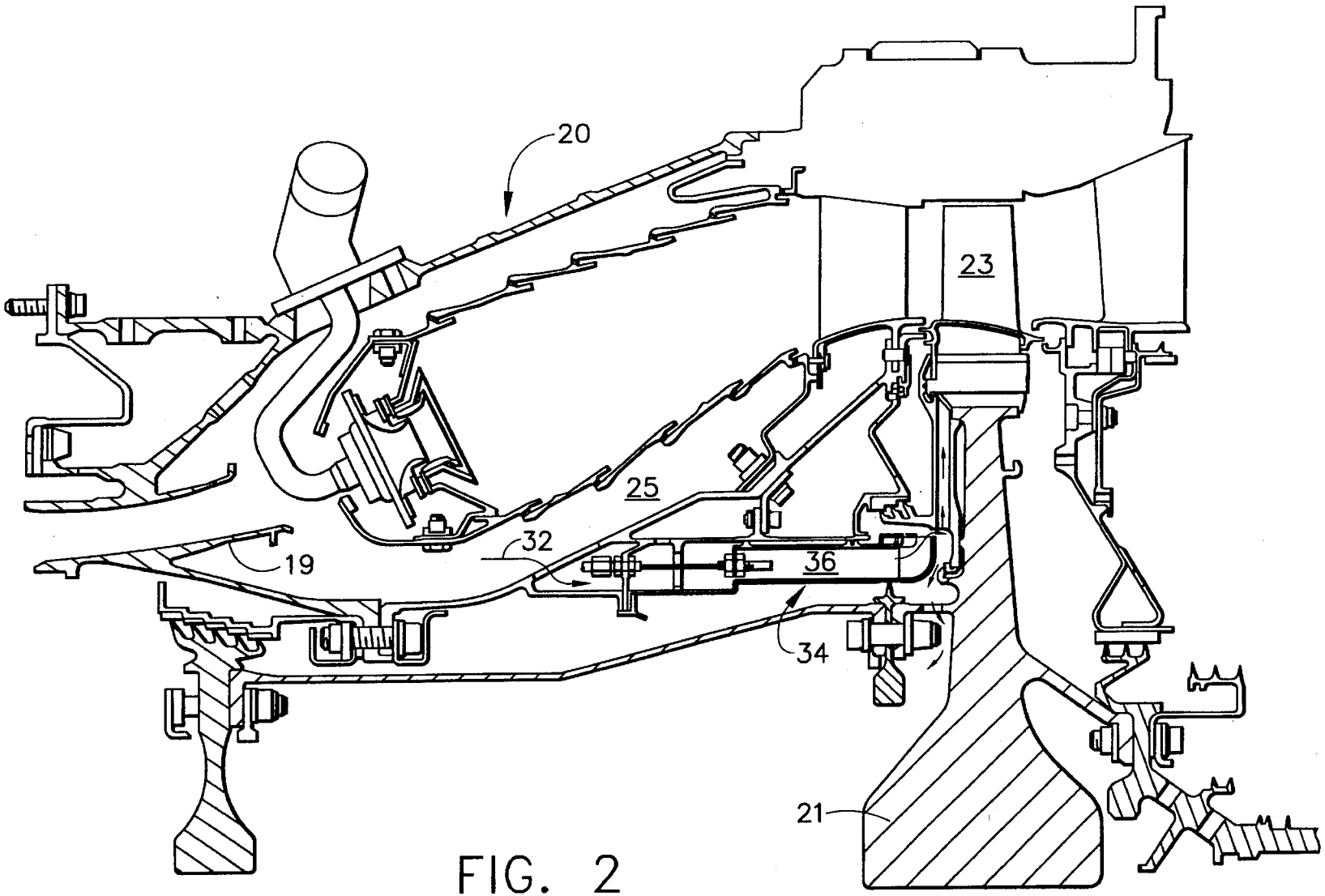
FIG. 2 is a partial, enlarged cross-sectional view of the combustor and high pressure turbine portions of the gas turbine engine of FIG. 1, including a turbine cooling flow modulation system in accordance with the present invention.

A portion of inlet air 26 is discharged from high pressure compressor 18 into combustor 20 through diffuser 19 and is used to cool high pressure turbine rotor components, such as turbine disk 21 and turbine blades 23, that are disposed in the engine flowpath (see FIG. 2). More specifically, cooling air 32 is diverted from an inner passage 25 of combustor 20 and channeled to a turbine cooling flow system 34 through an annular channel 36, the aft portion of which is defined by an inner wall 38 and an outer wall 40 of a support member 42. Support member 42 is held stationary by means of bolted connections 44 to a nozzle support 46.

Figure 3:
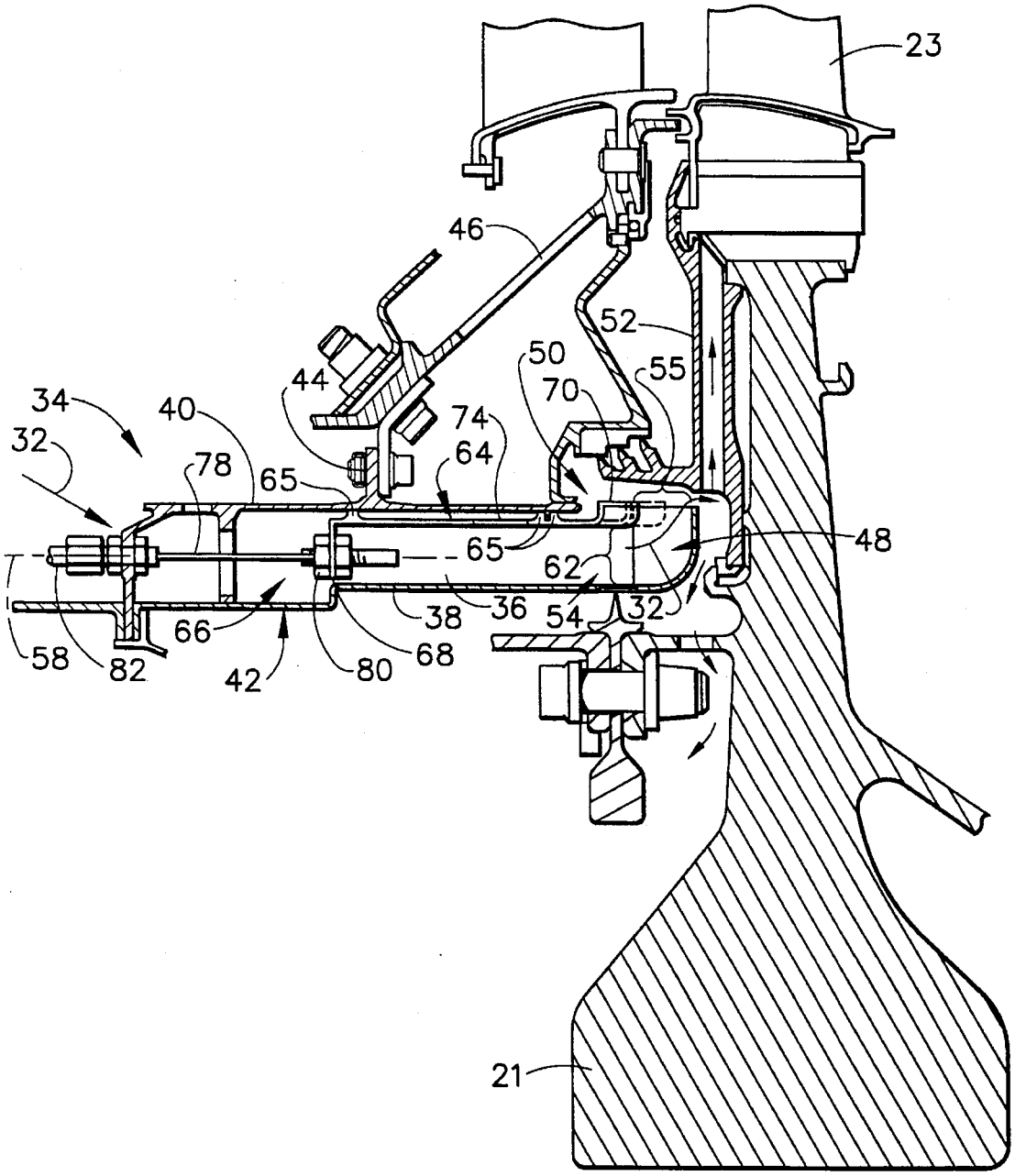
FIG. 3 s a partial, enlarged cross-sectional view of the turbine cooling flow modulation system shown in FIG 2.
Figure 8:
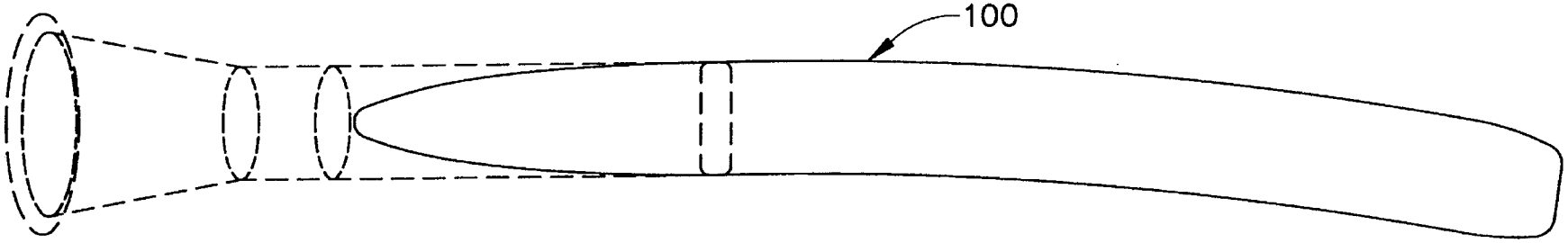
FIG. 8 is a cross-sectional view of an inducer having cylindrical passages rather than vanes in accordance with an alternate embodiment of the present invention.

Turbine cooling flow system 34, as best seen in FIG. 3, includes support member 42, an annular radial flow inducer 48, a means 50 for modulating cooling flow through radial flow inducer 48 and a radial impeller 52 which channels cooling air 32 to high pressure turbine blades 23. Radial flow inducer 48 is mounted at a downstream end 54 of channel 36 adjacent a radial throat 55. Radial flow inducer 48 preferably includes an array of radially-oriented stationary vanes 56 circumferentially disposed about a longitudinal axis 58 of channel 36 (see FIG. 4). Vanes 56 are sized to be able to provide an adequate flow of cooling air 32 at maximum temperature conditions. The area of throat 55 is significantly greater than an inlet area 62 of vanes 56, causing cooling air 32 to be accelerated to a velocity substantially equal to the tangential velocity of radial impeller 52 mounted on the upstream side of high pressure turbine disk 21. Radial flow inducer 48 may alternatively include a plurality of cylindrical airflow passages 100 disposed in an annular fashion about longitudinal axis 58, an illustration of one such passage being shown in FIG. 8.

The modulation of cooling flow 32 is provided by an endwall 64 and a means 66 for actuation thereof. More specifically, endwall 64 includes a first portion 68 substantially transverse to longitudinal axis 58 of channel 36, a second portion 70, having a circumferentially disposed array of contoured plugs 72, radially outboard of first portion 68 and adjacent to throat 55 of support member 42, and a third portion 74 connecting first portion 68 and second portion 70 adjacent to and substantially parallel with outer wall 40. Referring again to FIG. 3, endwall 64 may be moved in a direction parallel to longitudinal axis 58 as indicated by dashed lines. This allows endwall 64 to cover a portion of throat 55 of channel 36 and radial flow inducer 48, wherein contoured plugs 72 fit into passageways 76 (see FIG. 4) between vanes 56 to provide an aerodynamically efficient flowpath for modulated cooling air 32. In this way, the flow of cooling air 32 through radial flow inducer 48 is varied in accordance with the cooling needs of turbine disk 21 and turbine blades 23. It will also be understood that one or more seals 65 may be positioned between endwall third portion 74 and outer radial wall 40 to prevent cooling air 32 from flowing back upstream in channel 36 after exiting radial flow inducer 48.

Endwall actuation means 66 may include, for example, components such as mechanical linkage, cable, or a combination thereof. In particular, endwall actuation means 66 shown in FIG. 3 includes a cable 78 connected to translating endwall 64 at first portion 68 by a connection 80, cable 78 operating in telescopic fashion to move endwall 64 in a direction parallel to longitudinal axis 58. Operation of cable 78 is controlled by an actuator (not shown) mounted on the outside of engine 10 which receives electrical input from high pressure turbine 22 regarding the amount of cooling air 32 needed.

During engine operation at maximum turbine inlet temperature, endwall 64 will be axially in its forwardmost position, leaving throat 55 and radial flow inducer 48 completely uncovered, unplugged, and free to provide the maximum amount of cooling flow 32. With high pressure turbine 22 adequately cooled for higher inlet temperatures, the efficiency of engine 10 will be improved by running engine 10 at higher temperatures without a penalty on the life of turbine components such as disk 21 or blades 23.

Figure 4:
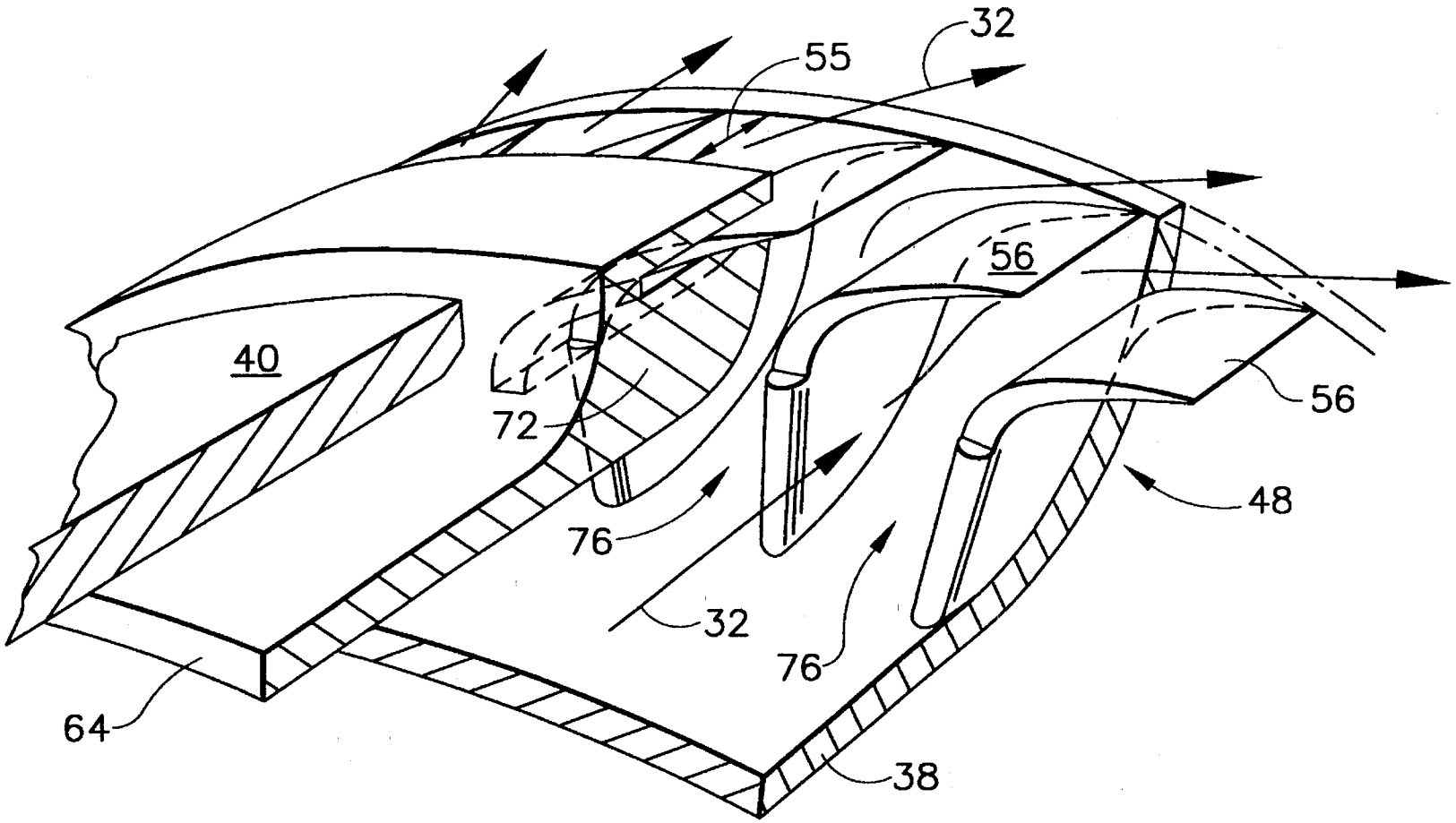
FIG. 4 is a partial perspective view of the exit end of the turbine cooling flow modulation system shown in FIGS 2 and 3.

When the engine is operating at conditions other than maximum turbine inlet temperature, a signal will be sent to actuation means 66 to throttle the flow of cooling air 32 through radial flow inducer 48 by moving endwall 64 aftward to a specific axial location over throat 55 that partially blocks vanes 56 of radial flow inducer 48 with plugs 72 as illustrated by dashed lines in FIG. 3 and in FIG. 4. This movement of endwall 64 to a specific axial location will allow only the amount of cooling flow 32 needed by high pressure turbine 22 to pass through radial flow inducer 48. With the capability to vary the amount of cooling flow 32 into high pressure turbine 22 according to its specific cooling needs at a given point in time, the efficiency of high pressure turbine 22 over the entire engine cycle will be increased and overall engine specific fuel consumption will be decreased.

Figure 5:
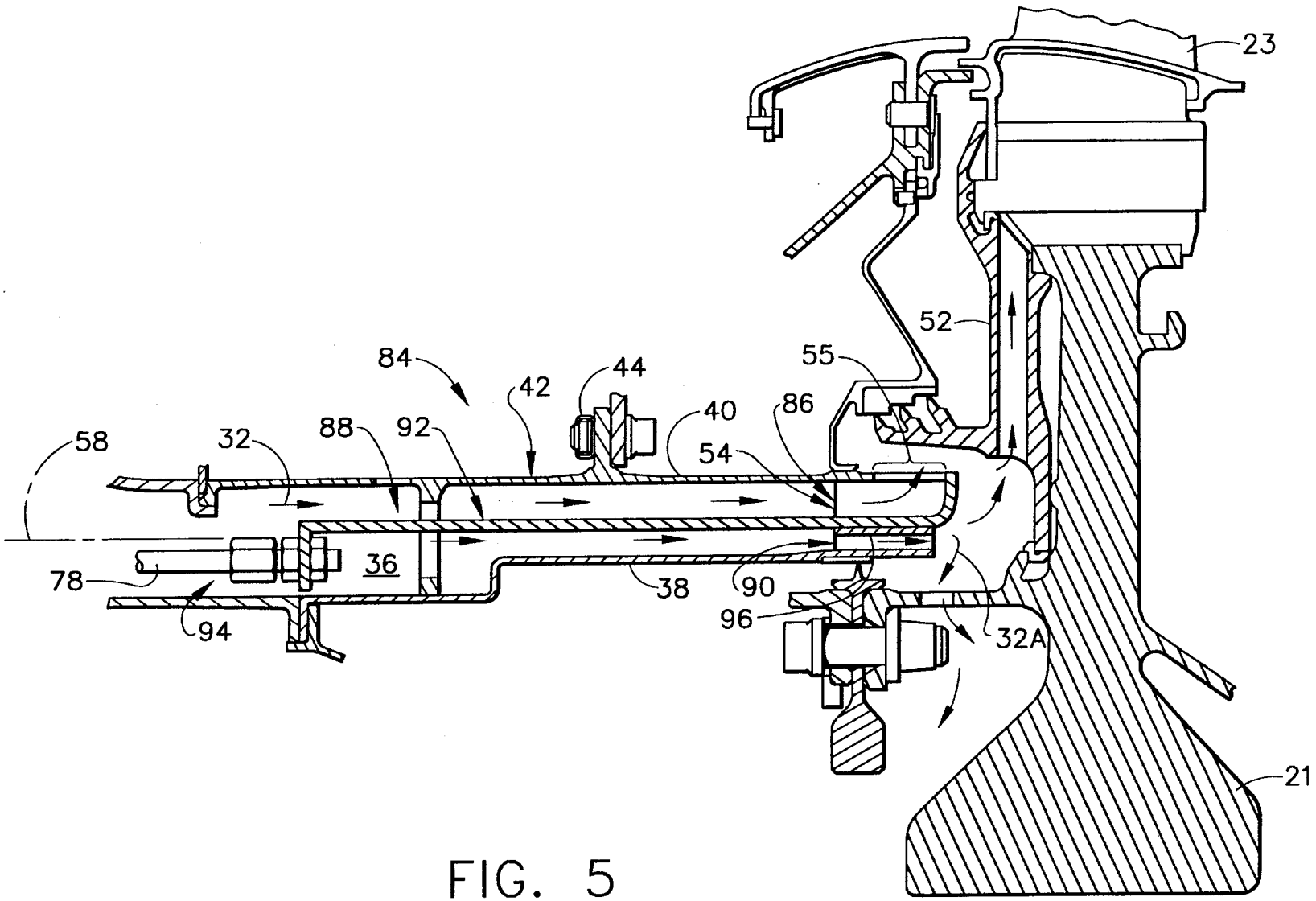
FIG. 5 is a partial cross-sectional view of a turbine cooling flow modulation system having a radial flow inducer and an axial flow inducer.

In a second embodiment of the present invention shown in FIG. 5, turbine cooling flow system 84 includes support member 42, an annular radial flow inducer 86, means 88 for modulating flow, and radial impeller 52. As with the embodiment shown in FIGS. 2 and 3, radial flow inducer 86 may include either an array of vanes or an array of cylindrical passages. Further, this embodiment includes an axial flow inducer 90 located radially inward of radial flow inducer 86 which operates unmodulated.

It will be understood that radial flow inducer 86 preferably is not stationary at downstream end 54 of channel 36, but instead translates axially in accordance with a movable endwall 92 since radial flow inducer 86 is preferably permanently connected thereto. Flow modulation means 88 once again includes endwall 92 and means 94 for axial actuation thereof; hence, radial flow inducer 86 is part of flow modulation means 88 in this embodiment. Inner wall 38 and outer wall 40 of support member 42 again create channel 36 through which cooling air 32 passes on its way toward high pressure turbine 22. Axial flow inducer 90 is fixedly connected to inner wall 38 and an intermediate wall 96 located at the downstream end 54 of channel 36. Endwall 92 and permanently connected radial flow inducer 86 reside adjacent to and radially outside of axial flow inducer 90. Endwall 92 uses intermediate wall 96 as a guide for linear translation and mechanical support.

During engine operation at maximum turbine inlet temperature conditions, endwall 92 and radial flow inducer 86 will be extended axially toward high pressure turbine 22 as far as possible to ensure maximum flow of cooling air 32 into turbine disk 21 and radial impeller 52. During all other conditions, endwall actuation means 94 will move endwall 92 axially forward to a position which, commensurate with the amount of cooling air 2 needed by high pressure turbine no effectively seals-off a portion of radial flow inducer 86. This sealing-off of radial flow inducer 86 is achieved by partially covering throat 55 and radial flow inducer 86 with outer wall 40 of support member 42. During all conditions, unmodulated axial flow inducer 90 remains stationary and provides a constant amount of cooling air 32A to other components in high pressure turbine 22.

Figure 6:
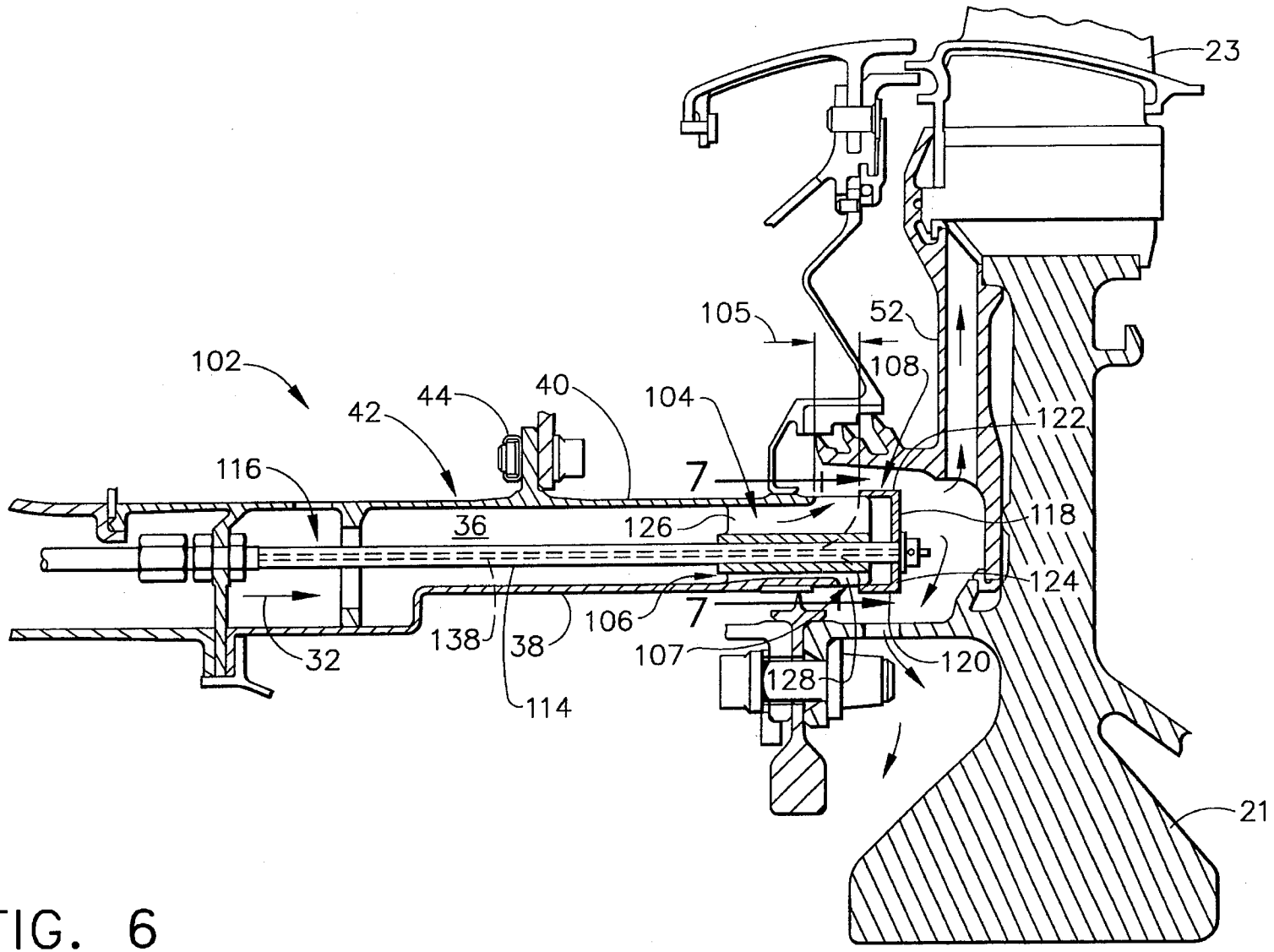
FIG. 6 is a partial cross-sectional view of a turbine cooling flow modulation system having two oppositely oriented radial flow inducers.

In a third embodiment of the present invention shown in FIG. 6, a turbine cooling flow system 102 includes support member 42, an annular high pressure radial flow inducer 104, an annular low pressure radial flow inducer 104, means 108 for flow modulation, and a radial impeller 52. High pressure and low pressure radial flow inducers 104 and 106, respectively, may include either an array of vanes or an array of cylindrical passages.

Figure 7:
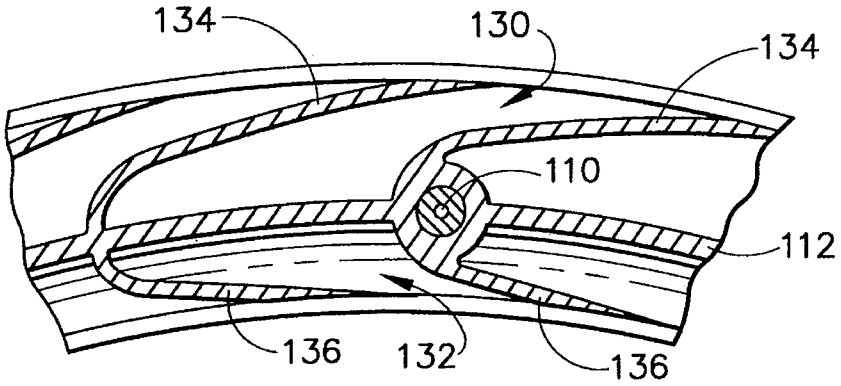
FIG. 7 is a partial cross-sectional view of the vane array in the radial flow inducers shown in FIG. 6 taken along line 7—7.

In this third embodiment, inner wall 38 and outer wall 40 of support member 42 again create channel 36 through which cooling air 32 passes to get to radial flow inducers 104 and 106, and thereafter through radial throats 105 and 107. Low pressure radial flow inducer 106 is attached to inner wall 38 of support member 42, with high pressure radial flow inducer 104 being mounted adjacent to and radially outward from low pressure radial flow inducer 106. High pressure radial flow inducer 104 is connected to outer wall 40 of support member 42 and to low pressure radial flow inducer 106. A series of equally spaced apertures 110 are located in a connection zone 112 between high pressure radial flow inducer 104 and low pressure radial flow inducer 106 (see FIG. 7).

The modulation of cooling flow 32 is provided by an endwall 114 and a means 116 for actuation thereof. Specifically, endwall 114 includes a cap 118 which has an inner radial wall 120, an outer radial wall 122, and a connecting wall 124 therebetween. In addition, two circumferentially disposed arrays of contoured plugs 126 and 128, respectively, are provided which fit into passageways 130 and 132 between vanes 134 and 136 in high pressure radial flow inducer 104 and low pressure radial flow inducer 106. In this way, aerodynamically efficient flowpaths are provided for cooling air 32 being modulated individually by the two radial flow inducers 104 and 106. Endwall actuation means 116, as shown in FIG. 6, includes a cable 138 which passes through endwall 114 and is fastened to connecting wall 124 of endwall cap 118. Cable 138 operates in telescopic fashion to move endwall 114 in a direction parallel to longitudinal axis 58. Cable 138 is controlled by an actuator (not shown) mounted outside of engine t0 which receives electrical input from high pressure turbine 22 regarding the amount of cooling air 32 needed.

During engine operation at maximum turbine inlet temperature conditions, endwall 114 is extended axially toward high pressure turbine 22 as far as possible to ensure maximum flow of cooling air 32 through adjustable radial throats 105 and 107 into high pressure and low pressure turbines 22 and 24, respectively. During all other conditions it will be understood that endwall 114, as well as contoured plugs 126 and 128, will move axially upstream to a position which, commensurate with the amount of cooling air 32 needed by turbines 22 and 24, effectively seals-off a portion of radial throats 105 and 107, radial flow high pressure inducer 104, and radial flow low pressure inducer 106. This sealing-off of radial flow inducers 104 and 106 is achieved by partially covering throats 105 and 107 of each inducer with one wall of cap 118 (outer radial wall 122 for radial flow high pressure inducer 104 and inner radial wall 120 for radial flow low pressure inducer 106), wherein contoured plugs 126 and 128 fit into passageways 130 and 132 between vanes 134 and 136 to provide aerodynamically efficient flowpaths for modulated cooling air 32.

Having shown and described the preferred embodiments of the present invention, further adaptations of the turbine cooling flow system for providing modulation of cooling air to the turbines of a gas turbine engine can be accomplished by appropriate modifications by one of ordinary skill in the art without departing from the scope of the invention.

What is claimed is:

1. An apparatus for modulating a flow of cooling air from a compressor to a turbine in a gas turbine engine, comprising:

(a) a channel for receiving said cooling air from said compressor at an upstream end and supplying said cooling air to said turbine at a downstream end, said channel downstream end having a throat oriented radially outward with respect to a centerline of said channel;

(b) a radial flow inducer positioned adjacent to said throat for accelerating the flow of said cooling air therethrough; and (c) means for modulating the quantity of said cooling air flowing through said throat into said turbine.

2. The apparatus of claim 1, wherein said radial flow inducer is a circumferentially disposed array of vanes.

3. The apparatus of claim 1, wherein said flow modulation means includes:

(a) an endwall movable in an axial direction substantially parallel to said channel centerline, said endwall having a first portion substantially transverse to said channel centerline, a second portion located radially outboard of said first portion and adjacent to said throat of said channel, and a third portion connecting said first portion and said second portion; and (b) means for actuating said endwall in said axial direction;

wherein said endwall is actuated so that said second portion thereof is positioned with respect to said radial flow inducer and said throat so as to allow a desired amount of cooling air flow through said throat to said turbine.

4. The apparatus in claim 1, wherein said flow modulation means maintains a constant relationship between an inlet gas temperature of said turbine and a desired amount of cooling air flow provided to said turbine, whereby maximum efficiency of said turbine is maintained.

5. The apparatus of claim 1, wherein said channel is formed by a support member of said gas turbine engine.

6. The apparatus of claim 3, said endwall second portion including a circumferentially disposed array of contoured plugs, wherein said contoured plugs interact with vanes of said radial inducer to partially seal off flow through said radial inducer when said endwall is actuated to reduce the amount of cooling flow through said throat.

7. The apparatus of claim 2, further including a radial impeller mounted on an upstream side of a turbine disk said radial impeller channeling air to blades of said turbine, wherein the area of said throat is greater than an inlet area in said channel to said vanes of said radial inducer, whereby said cooling flow is accelerated substantially equal to a tangential velocity of said radial impeller.

8. The apparatus of claim 3, said endwall actuating means comprising a cable connected to said endwall which operates in telescopic fashion to move said endwall and an actuator which causes said cable to move in response to the amount of cooling air needed by said turbine.

9. The apparatus of claim 3, wherein said endwall is at its forwardmost position and said throat and said radial flow inducer are completely open during operation of said gas turbine engine at maximum turbine inlet temperature.

10. The apparatus of claim 1, further comprising an axial flow inducer positioned in said channel radially inward and independent of said radial flow inducer.

11. The apparatus of claim 10, wherein said flow modulation means includes:

(a) an endwall movable in an axial direction substantially parallel to said channel centerline; and (b) means for actuating said endwall in said axial direction;

wherein said endwall is actuated so that it is positioned with respect to said throat so as to allow a desired amount of cooling air flow through said throat to said turbine.

12. The apparatus of claim 11, wherein said radial flow inducer is connected to and moves with said endwall.

13. The apparatus of claim 10, further comprising a wall in said channel separating said radial flow inducer and said axial flow inducer.

14. The apparatus of claim 1, further comprising a second throat in said channel oriented radially inward, a second radial flow inducer positioned adjacent said radially inward throat for accelerating the flow of cooling air therethrough, and means for modulating the quantity of said cooling air flowing through said radially inward throat.

15. The apparatus of claim 14, wherein both of said radial flow inducers include a circumferentially disposed array of vanes.

16. The apparatus of claim 14, said flow modulation means for said radially outward and said radially inward throats comprising:

(a) an endwall movable in an axial direction substantially parallel to said channel centerline, said endwall including a cap portion at its downstream end; and (b) means for actuating said endwall in said axial direction;

wherein said endwall is actuated so that said cap portion is positioned with respect to said throats so as to allow a desired amount of cooling air flow therethrough.

17. The apparatus of claim 16, said cap portion including a pair of circumferentially disposed arrays of contoured plugs, wherein said contoured plugs interact with vanes of both said radial inducers when said endwall is actuated to reduce the amount of cooling flow through said throats.

18. The apparatus of claim 16, wherein said outer and inner radial flow inducers are connected to each other and an outer and inner wall of said channel, respectively.

19. The apparatus of claim 3, further including sealing means between said endwall and an outer radial wall of said channel.

* * * * *